US009067421B2

(12) United States Patent
Kagata et al.

(10) Patent No.: US 9,067,421 B2
(45) Date of Patent: Jun. 30, 2015

(54) INKJET PRINTER

(71) Applicant: Seiko Epson Corporation, Tokyo (JP)

(72) Inventors: Takayoshi Kagata, Shiojiri (JP); Shoki Kasahara, Mobara (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/305,290

(22) Filed: Jun. 16, 2014

(65) Prior Publication Data

US 2014/0375709 A1 Dec. 25, 2014

(30) Foreign Application Priority Data

Jun. 19, 2013 (JP) ..... 2013-128480
Jun. 12, 2014 (JP) ..... 2014-121215

(51) Int. Cl.
*B41J 29/393* (2006.01)
*B41J 2/175* (2006.01)
*B41J 29/38* (2006.01)

(52) U.S. Cl.
CPC . *B41J 2/175* (2013.01); *B41J 29/38* (2013.01)

(58) Field of Classification Search
CPC ..... B41J 29/393; B41J 1/0095; B41J 2/2142; B41J 1/42; B41J 2/2132; B41J 1/009; B41J 2/04505
See application file for complete search history.

(56) References Cited

U.S. PATENT DOCUMENTS 6,059,405 A 5/2000 Mochizuki et al.
8,398,190 B2 3/2013 Kumagai

FOREIGN PATENT DOCUMENTS

JP 11-048491 2/1999
JP 11-048492 2/1999
JP 11-048493 2/1999
JP 2012-096502 A 5/2012
JP 2012-111060 A 6/2012

*Primary Examiner* — Lamson Nguyen
(74) *Attorney, Agent, or Firm* — Harness, Dickey & Pierce, P.L.C.

(57) ABSTRACT

An ink jet printer according to the present invention includes a liquid accommodation body which is provided with a liquid accommodation chamber which accommodates a liquid that generates a gas as time elapses due to a chemical change in contained components, a liquid flow port which communicates with the liquid accommodation chamber and allows the liquid to flow therethrough, and a gas flow port which communicates with the liquid accommodation chamber and allows the gas to flow therethrough; a recording head which communicates with the liquid flow port and ejects the liquid which flows out from the liquid flow port; and gas discharge means which communicates with the gas flow port and allows the gas to flow out to outside of the liquid accommodation body.

9 Claims, 7 Drawing Sheets

(A)

(B)

| ELAPSED TIME (Hour) | AMOUNT OF GAS GENERATED (ml) | | | |
|---|---|---|---|---|
| | INK A | INK B | INK C | INK D |
| t1 | a1 | b1 | c1 | d1 |
| t2 | a2 | b2 | c2 | d2 |
| t3 | a3 | b3 | c3 | d3 |
| ⋮ | ⋮ | ⋮ | ⋮ | ⋮ |
| tn | an | bn | cn | dn |

(C)

| THRESHOLD T (Hour) | | | |
|---|---|---|---|
| INK A | INK B | INK C | INK D |
| Ta | Tb | Tc | Td |

INKJET PRINTER

BACKGROUND ART

The present invention relates to an ink jet printer.

An ink jet printer is provided with a recording head which includes nozzle holes, driving means (for example, a piezoelectric oscillator or a heating element) which causes an ink to be ejected from the nozzle holes, and control means which controls the driving means according to data. The supply of the ink to the nozzle holes is performed using a liquid accommodation body (for example, an ink cartridge or the like); and normally, the ink cartridge can be replaced.

The recording quality of the ink jet printer depends on a nozzle density of the recording head which is defined by the diameter, the number and the like of the nozzle holes; however, in addition to this, the recording quality is also influenced by the type or the viscosity of the ink, the wetting condition of the ink on a recording medium, and the like.

In addition, when bubbles or a precipitate are present in the ink, there is a case in which the ejecting of the ink from the nozzle holes becomes unstable, and there is a case in which the stability of the apparatus also influences the recording quality. Therefore, there is also a case in which ejection stability can be obtained by suctioning the ink from the nozzle holes (referred to as cleaning), for example. For example, in JP-A-11-048491, JP-A-11-048492, and JP-A-11-048493, an ink jet printer provided with a deaeration mechanism has been proposed, and discharging of the bubbles and the like has been attempted. These documents disclose that the gas that is dissolved in the ink is deaerated by the deaeration mechanism, and stable ejecting performance is obtained and the like.

SUMMARY OF INVENTION

However, in ink jet recording, there are examples which become the cause of bubbles other than dissolved gas. For example, in the case of an ink in which a metallic pigment is aluminum and there is water in a dispersion medium, there is a case in which the aluminum reacts with the water during storage or during usage, a gas is generated, and bubbles are easily generated in the ink. In such a case, there is a case in which cleaning in which an ink containing bubbles (gas) is suctioned from the nozzle holes as described above is performed; however, since the nozzle holes are being used for the recording during the recording, it is difficult to perform the cleaning at the same time as the recording. Therefore, there is a tendency for, the longer the recording time becomes, the greater the number of problems in which the bubbles (the gas) which is generated in the ink enters the nozzle holes.

In addition, when an ink that generates a gas easily in this manner due to a reaction is accommodated in a so-called sealed-type liquid accommodation body in which a liquid accommodation chamber is not open to the atmosphere, there is a case in which the internal pressure of the liquid accommodation chamber rises due to the gas which is generated in the ink. Furthermore, there is a concern that when the internal pressure exceeds the pressure capacity of the liquid accommodation chamber or the liquid accommodation body, the liquid accommodation chamber or the liquid accommodation body will be damaged.

One object according to several aspects of the present invention is to provide an ink jet printer which, even when a liquid accommodation body that accommodates a liquid that easily generates a gas (bubbles) is mounted, is capable of stably supplying the liquid, and, which is capable of preventing damage to the liquid accommodation body.

The present invention was created in order to solve at least a part of the problems and may be realized as the aspects or application examples hereinafter.

According to an aspect of the present invention, an ink jet printer includes a liquid accommodation body which is provided with a liquid accommodation chamber which accommodates a liquid that generates a gas as time elapses due to a chemical change in contained components, a liquid flow port which communicates with the liquid accommodation chamber and allows the liquid to flow therethrough, and a gas flow port which communicates with the liquid accommodation chamber and allows the gas to flow therethrough; a recording head which communicates with the liquid flow port and ejects the liquid which flows out from the liquid flow port; and gas discharge means which communicates with the gas flow port and allows the gas to flow out to outside of the liquid accommodation body.

According to the ink jet printer related to the present invention, even when a liquid accommodation body that accommodates a liquid that easily generates a gas (bubbles) is mounted, it is possible to stably supply the liquid, and, it is possible to prevent damage to the liquid accommodation body.

At least one type of the contained components may be a base metal pigment.

The base metal pigment may be covered by a protective film.

The gas discharge means may be provided with a valve and a suction mechanism.

The ink jet printer according to the present invention may further include at least one of time measurement means which measures the elapsed time from the previous discharge operation of the gas, and internal pressure measurement means which measures the internal pressure in the liquid accommodation chamber.

The ink jet printer according to the present invention may further include control means; in which the control means causes the gas discharge means to operate based on information of at least one of elapsed time information from the time measurement means, and internal pressure information from the internal pressure measurement means.

The gas discharge means may discharge the liquid of an inner portion of the liquid accommodation chamber together with the gas which is generated in the liquid accommodation chamber.

The ink jet printer according the present invention may further include notification means which notifies a user of a disposal method of the liquid accommodation body that is removed when the liquid accommodation body is removed from the ink jet printer and is replaced with a different liquid accommodation body.

DESCRIPTION OF EMBODIMENTS

Hereinafter, description will be given of favorable embodiments of the present invention. The embodiments described hereinafter describe examples of the present invention. In addition, the present invention is not limited by the following embodiments and includes various modification examples carried out in a range not departing from the gist of the present invention.

1. Ink Jet Printer

Detailed description will be given below of the apparatus configuration of an ink jet printer according to an embodiment of the present invention with reference to the drawings. Note that, since in order to facilitate understanding of the structure of the ink jet printer according to the embodiment of the present invention, there is a case in which the scale is changed as appropriate.

Figure 1:
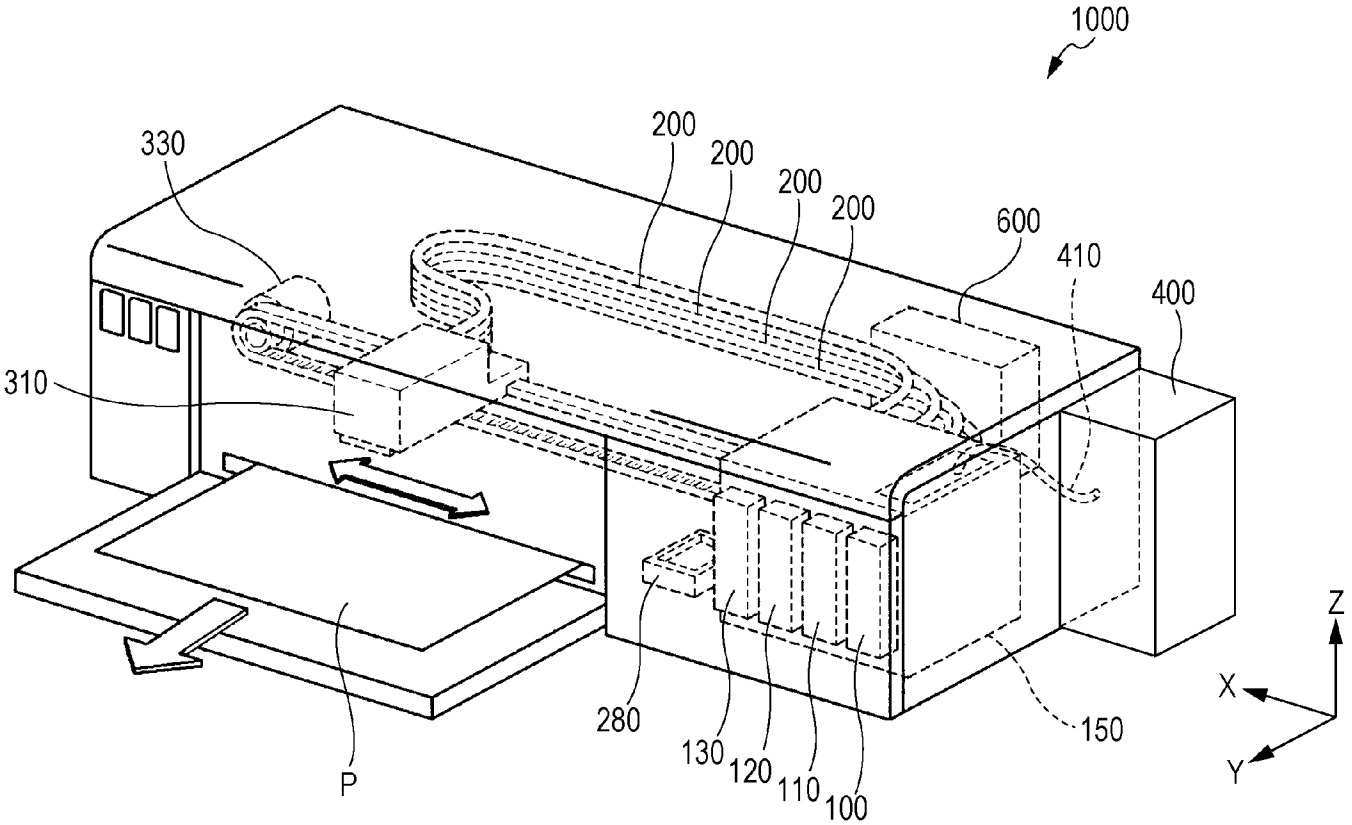
FIG. 1 is a perspective view schematically showing an ink jet printer according to an embodiment of the present invention.
Figure 2:
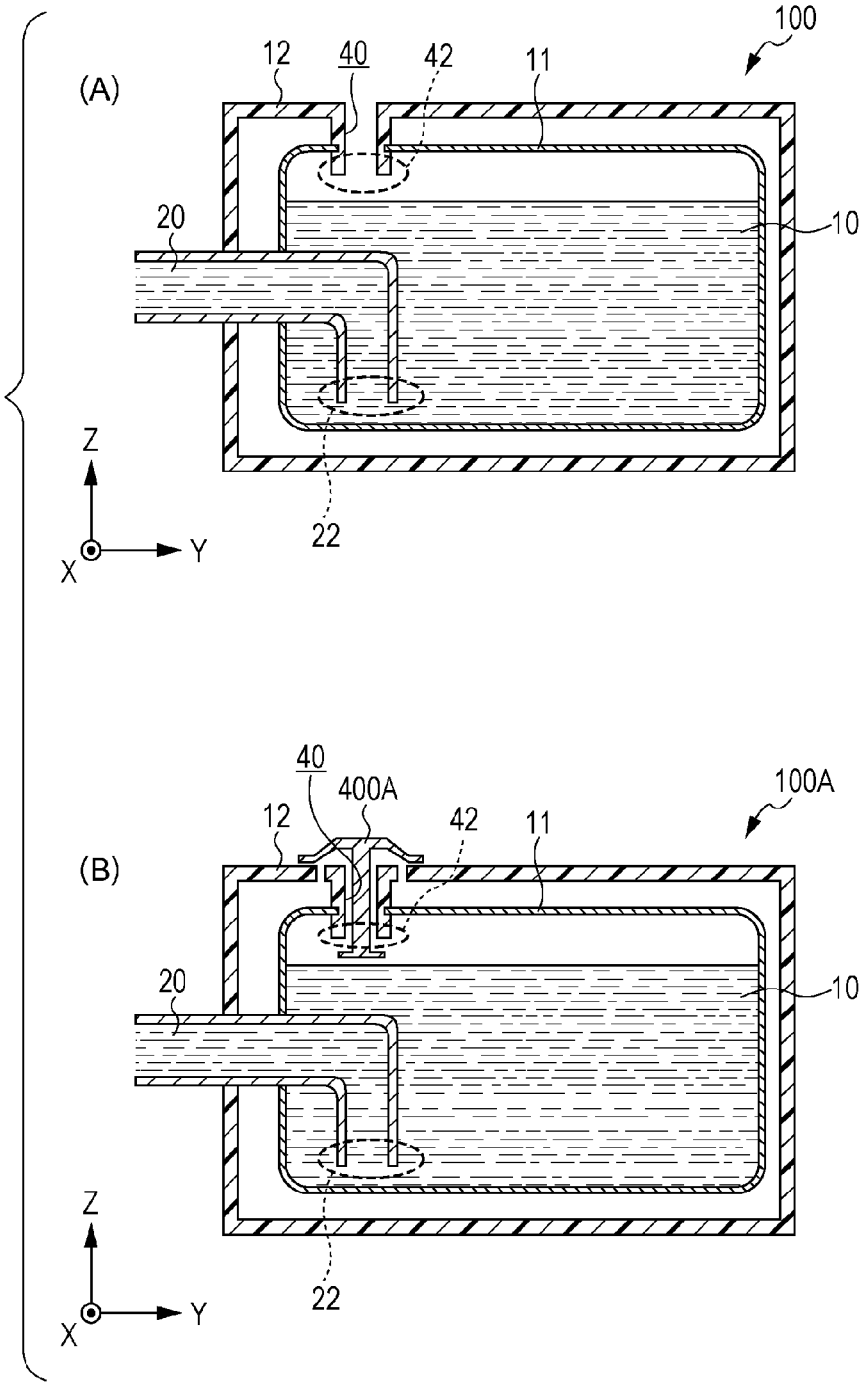
FIG. 2(A) is a schematic view of a cross section of a liquid accommodation body which can be mounted to the ink jet printer according to an embodiment of the present invention.
FIG. 2(B) is a schematic view of a cross section of a liquid accommodation body according to a modification example.

FIG. 1 is a perspective view schematically showing an ink jet printer 1000 according to the present embodiment. FIG. 2(A) is a schematic view of a cross section of a liquid accommodation body 100 which can be mounted to the ink jet printer 1000 (hereinafter, also referred to simply as the "printer 1000") according to the present embodiment. Axes X, Y and Z which intersect each another in a perpendicular manner are depicted in FIG. 1 and FIG. 2(A). In the present embodiment, in the usage orientation of the printer 1000, the Z axis is the vertical direction (the gravity direction), the Y axis is a direction in which the liquid accommodation body 100 is attached to and detached from a cartridge holder 150, and the X axis is a direction in which a plurality of liquid accommodation bodies 100, 110, 120, and 130 are lined up. More specifically, the +Z axis direction is the vertically upward direction, the −Z axis direction is the vertically downward direction, the +Y axis direction is the removal direction of the liquid accommodation body 100, and the −Y axis direction is the insertion direction of the liquid accommodation body 100. The ink jet printer 1000 according to the present embodiment includes the four liquid accommodation bodies 100, 110, 120, and 130, gas discharge means 400, a recording head 310 and the like.

1.1. Liquid Accommodation Body

As shown in FIG. 1, the liquid accommodation bodies 100, 110, 120, and 130 are mounted to the printer 1000 by being inserted into the cartridge holder 150. The liquid accommodation body 100 can be attached to and detached from the cartridge holder 150. When, for example, little of the ink remains, or when the ink is old, the user can remove the old liquid accommodation bodies 100, 110, 120, and 130 from the cartridge holder 150 and replace them with new liquid accommodation bodies.

In addition, as shown in FIG. 1, the four liquid accommodation bodies 100, 110, 120, and 130 are mounted to the printer 1000, lined up in the X direction. In the present embodiment, a case in which four of the liquid accommodation bodies are mounted is shown; however, there may be three or less, and there may be five or more.

In the printer 1000 according to the present embodiment, normal color ink is accommodated in the liquid accommodation bodies 110, 120, and 130. Therefore, in the liquid accommodation bodies 110, 120, and 130, a gas is not easily generated from the liquid (the ink) contained in the inner portions thereof in comparison to the liquid accommodation body 100. Meanwhile, a liquid which generates a gas as time elapses due to a chemical change in the contained components is accommodated in the liquid accommodation chamber 10 of the liquid accommodation body 100. The liquid accommodation bodies 100, 110, 120, and 130 are of a so-called sealed-type liquid accommodation body in which none of the liquid accommodation portions thereof are exposed to the atmosphere. Accordingly, in the liquid accommodation body 100, the internal pressure of the sealed liquid accommodation chamber 10 rises easily due to the gas which is generated in the inner portion of the liquid accommodation portion. Accordingly, it is preferable that the capacity of the liquid accommodation chamber of the liquid accommodation body 100 be greater than the capacity of the liquid accommodation chambers of the other liquid accommodation bodies 110, 120, and 130. Accordingly, even if a gas is generated inside the liquid accommodation chamber 10, the liquid accommodation body 100 is not damaged easily in comparison to the liquid accommodation bodies 110, 120, and 130 for normal color ink.

As the type of the liquid accommodation body, the sealed-type liquid accommodation body such as the liquid accommodation bodies 100, 110, 120, and 130 of the present embodiment, and a so-called open-type liquid accommodation body in which the liquid accommodation portion is open to the atmosphere exist. In the open-type liquid accommodation body, the atmosphere is introduced into the liquid accommodation chamber from the outside with the consumption of the liquid inside the liquid accommodation chamber. In other words, in the open-type liquid accommodation body, the consumed liquid is replaced by the atmosphere, and the volume of the liquid accommodation chamber is substantially fixed. In addition, a flow path for introducing the atmosphere into the liquid accommodation chamber from the outside with the consumption of the liquid inside the liquid accommodation chamber is provided in the open-type liquid accommodation body. The flow path is referred to as an atmosphere flow path, an atmosphere introduction path or the like. Meanwhile, in the sealed-type liquid accommodation body such as the liquid accommodation bodies 100, 110, 120 and 130 according to the present embodiment, the liquid is not replaced by the atmosphere, and the volume of the liquid accommodation chamber is reduced with the consumption of the liquid. In addition, an atmosphere introduction path or an atmosphere communication path is not provided.

As described earlier, in the present embodiment, a liquid which generates a gas as time elapses due to a chemical change in the contained components which will be described later is only accommodated in the liquid accommodation body 100. Normal color ink is accommodated in the other liquid accommodation bodies 110, 120, and 130. Hereinafter, detailed description will be given of the internal configuration of the liquid accommodation body 100 using FIG. 2(A), and the other liquid accommodation bodies 110, 120, and 130 are configured in the same manner as the liquid accommodation body 100 except in that a gas flow port 42 is not provided. Note that, in the same manner as the liquid accommodation body 100, a liquid which generates a gas as time elapses due to a chemical change in the contained components may be accommodated in all or some of the other liquid accommodation bodies 110, 120, and 130. In this case, the structure of the other liquid accommodation body is preferably the same as that of the liquid accommodation body 100.

<Internal Configuration of Liquid Accommodation Body>

As shown in FIG. 2(A), the liquid accommodation body 100 according to the present embodiment is provided with the liquid accommodation chamber 10, a liquid flow path 20 which communicates with the liquid accommodation chamber and allows the liquid to flow therethrough, and the gas flow port 42 which communicates with the liquid accommodation chamber and allows the gas to flow therethrough. A liquid which generates a gas as time elapses due to a chemical change in the contained components is accommodated in the liquid accommodation chamber 10. The liquid inside the liquid accommodation chamber 10 is supplied to the recording head 310, which is described later, via the liquid flow path 20. In addition, the gas which is generated inside the liquid accommodation chamber 10 is discharged to the outside via a gas flow path 40. Note that, while described later in detail, the gas flow path 40 is a flow path for discharging the gas which is generated inside the liquid accommodation chamber 10 to the outside. The gas flow path 40 is not a flow path for opening the liquid accommodation chamber 10 to the atmosphere (an atmosphere introduction path or an atmosphere communication path).

<Liquid Accommodation Chamber>

The liquid accommodation chamber 10 can be formed using a film, a molded product or the like, for example. In the present embodiment, the liquid accommodation chamber 10 is formed using a flexible film, and the liquid accommodation chamber 10 is accommodated in the inner portion of a housing 12 with comparatively low flexibility. The liquid accommodation chamber 10 itself can be formed using a comparatively strong molded product, and in this case, it is possible to omit the housing 12. In the example of FIG. 2(A), in the liquid accommodation body 100, the liquid accommodation chamber 10 is disposed on the inside of the housing 12 which is formed of a resin molded product, and is formed of a bag-shaped film (an ink pack) 11.

The ink pack 11 which forms the liquid accommodation chamber 10 may be configured of a deposited film of a polymer or a metal or the like, and may be a multi-layered structure. The housing 12 is a resin molded product; however, the housing 12 can also be formed of metal or paper. When the liquid accommodation body 100 is formed of a plurality of members such as the ink pack 11 and the housing 12, a welded portion or a bonded portion is preferably formed. It is preferable that the ink pack 11 and the housing 12 be formed of a material with a low gas permeability in order to prevent an organic solvent or water contained in the liquid (the ink) from volatilizing and diffusing. For example, in a case such as the base metal pigment described later, in which hydrogen gas is generated as time elapses due to a reaction with water, it is preferable to use a material with excellent hydrogen gas permeability. In addition, of the materials of the ink pack 11 and the housing 12 which form the liquid accommodation chamber 10, it is preferable that the material of the portion which is in contact with the accommodated liquid be stable in relation to the accommodated liquid.

The shape and the volume of the liquid accommodation chamber 10 are not particularly limited. The liquid is accommodated in the liquid accommodation chamber 10, and a solid or a gas may be accommodated with the liquid. The volume of the liquid which is accommodated in the liquid accommodation chamber 10 is not particularly limited.

<Liquid Flow Port>

The liquid accommodation chamber 10 communicates with a liquid flow path 20 which communicates between the inner portion of the liquid accommodation chamber 10 and the outside of the liquid accommodation body 100. The liquid flow path 20 is a path for supplying the liquid to the recording head 310 from the liquid accommodation chamber 10. The liquid flow path 20 is connected to a liquid supply tube 200. The liquid which is accommodated in the liquid accommodation chamber 10 is supplied to the recording head 310 from the liquid flow path 20 via the liquid supply tube 200 (refer to FIG. 1). The shape of the liquid flow path 20 is not particularly limited, and it is possible to adopt a shape appropriate for connection to the liquid supply tube 200.

The liquid flow path 20 is, for example, formed of a metal tube, a molded product of a polymer material or the like. When the liquid flow path 20 is formed of a molded product of a polymer material, the molded product may be formed integrally with the member which forms the ink pack 11, or may be formed separately and subsequently connected using welding, bonding or the like. In the illustrated example, the liquid flow path 20 is formed of a resin which is formed in a cylindrical shape.

An end portion (a liquid flow port) 22 of the inner portion side of the liquid accommodation chamber 10 of the liquid flow path 20 is open at the inner portion of the liquid accommodation chamber 10. In the present embodiment, in a state in which the liquid accommodation body 100 is mounted to the printer 1000, the liquid flow port 22 is provided closer to the lower side (the −Z axis direction side) than a position of the center in the vertical direction (the Z axis direction) of the liquid accommodation chamber 10. By providing the liquid flow port 22 in such a position, the liquid is allowed to flow out more easily than a case in which the liquid flow port 22 is provided in a position close to the center in the vertical direction.

In addition to the liquid flow path 20, the liquid accommodation body according to the present embodiment may be further provided with a liquid filling path for filling the inner portion of the liquid accommodation chamber 10 with the liquid. In order to render the liquid accommodation chamber 10 sealed in relation to the atmosphere, the liquid filling path is blocked after the liquid accommodation chamber 10 is filled with the liquid. Any method may be used as the method of blocking the liquid filling path, as long as the method is capable of sealing the liquid accommodation chamber 10 in relation to the atmosphere. For example, various methods are conceivable, such as attaching a sealing stopper to the inlet of the filling path, bonding a film to the inlet of the filling path, or melting the inlet of the filling path with heat.

<Gas Flow Port>

The liquid accommodation chamber 10 communicates with a gas flow path 40 which communicates between the inner portion of the liquid accommodation chamber 10 and the outside of the liquid accommodation body 100. The gas flow path 40 is a flow path for discharging the gas which is generated inside the liquid accommodation chamber 10 to the outside. In the present embodiment, the gas flow path 40 is connected to the gas discharge means 400 (refer to FIG. 1) via a gas discharge tube 410 (refer to FIG. 1).

The shape of the gas flow path 40 is not particularly limited, and it is possible to adopt a shape appropriate for connection to the gas discharge tube 410 for introducing the liquid (the ink) into the gas discharge means 400. In addition, two or more of the gas flow paths 40 may be provided, and in this case, the discharge efficiency of the gas is improved.

The gas flow path 40 is, for example, formed of a metal tube, a molded product of a polymer material or the like. When the gas flow path 40 is formed of a molded product of a polymer material, the molded product may be formed integrally with the member which forms the liquid accommodation chamber 10, or may be formed separately and subsequently connected using welding, bonding or the like. In the illustrated example, the gas flow path 40 is formed of a resin which is formed in a cylindrical shape.

An end portion (the gas flow port) 42 of the inner portion side of the liquid accommodation chamber 10 of the gas flow path 40 is open at the inner portion of the liquid accommodation chamber 10. In the orientation in which the liquid accommodation body 100 is mounted to the printer 1000, the gas flow port 42 is provided on the top surface of the liquid accommodation chamber 10. This is because, in the orientation in which the liquid accommodation body 100 is mounted to the printer 1000, the gas collects at the upper side in the vertical direction. The position in which the gas flow port 42 is provided is not limited to the top surface of the liquid accommodation chamber 10; however, by providing the gas flow port 42 on the top surface of the liquid accommodation chamber 10, it is possible to discharge the gas more efficiently. It is preferable to provide the gas flow port 42 closer to the upper side (the +Z axis direction side) than the center in the vertical direction of the liquid accommodation chamber 10 from a perspective of discharging the gas more efficiently.

The liquid accommodation body 100 according to the present embodiment is provided with a liquid flow path (the liquid flow path 20) which is used for supplying the ink to the head, and a gas flow path (the gas flow path 40) for discharging the gas which is generated in the inner portion of the liquid accommodation chamber 10 separately. Therefore, even when the gas is generated in the inner portion of the liquid accommodation chamber 10 during recording, it is possible to discharge the gas to the outside of the liquid accommodation body 100 without interrupting the recording. In addition, when the gas is discharged by the gas flow path 40, there is a case in which the liquid will also be discharged at the same time; however, since it is possible to suppress the amount of such liquid to a lower amount, it is possible to reduce the consumption amount of the liquid. Meanwhile, it is conceivable to perform the discharging of the ink and the discharging of the gas using only the liquid flow path 20 without providing the liquid flow path 20 and the gas flow path 40 separately; however, in this case, it is necessary to interrupt the recording to carry out the gas discharge operation. In addition, when discharging the gas, there is a high likelihood that the amount of the liquid which is discharged at the same time is increased, and there is a high likelihood that the consumption amount of the liquid will increase.

<Chronological Information>

The liquid accommodation body 100 of the present embodiment is preferably provided with an information holding section 30 (refer to FIG. 3) which holds the chronological information relating to the manufacture of the liquid accommodation body 100. The information holding section 30 (refer to FIG. 3), for example, can be configured by a medium which is attached to the housing 12 of the liquid accommodation body 100. Examples of the medium include a label, a seal, a sticker, a mark, a tag, a semiconductor chip, and an RFID (Radio Frequency Identification). In addition, the information holding section 30 (refer to FIG. 3) may be characters, symbols or the like which are directly engraved, printed or the like onto the housing 12 or the ink pack 11 of the liquid accommodation body 100.

The chronological information relating to the manufacture of the liquid accommodation body 100 is used for understanding the amount of gas that the liquid which is accommodated in the liquid accommodation body 100 will generate. The "chronological information" is at least one of a date, a time, and an elapsed period.

The chronological information is selected according to the characteristics of the liquid which is accommodated in the liquid accommodation body 100. For example, when the speed at which the gas is generated from the liquid is slow, even if the information relating to the time is not selected, there is a case in which it is sufficient if the date is selected. In this case, the information relating to the time being selected in addition to the date is not impeded. In addition, for example, when the speed at which the gas is generated from the liquid is high, there is a case in which the information relating to the time (the hour, minute, second and the like) is selected. Furthermore, in relation to the elapsed period, in the same manner, an elapsed period from a specific time (years, months, days, hours, minutes, seconds and the like) is selected according to the characteristics of the liquid. When the liquid accommodation body 100 is caused to hold information of the date and the time, for example, a semiconductor chip with the information stored thereon may be attached to the liquid accommodation body 100, or the information may be printed on the housing 12 of the liquid accommodation body 100. When the liquid accommodation body 100 is caused to hold the information of the elapsed period, for example, a time measurement circuit may be provided in the liquid accommodation body 100.

The "manufacture of the liquid accommodation body 100" includes not only the completion of the liquid, the ink pack, and the liquid accommodation body, but also the filling of the ink pack with the liquid, the packaging of the liquid accommodation body, the shipping of the liquid accommodation body and the like. The term "manufacture of the liquid accommodation body 100" includes the series of acts relating to acts from acts for manufacturing the liquid accommodation body to the shipping to the customer. Examples of the "information relating to the manufacture of the liquid accommodation body 100" include, in relation to the liquid which is accommodated in the liquid accommodation body 100, the manufacture of the components of the liquid, the manufacture of the liquid, the accommodation of the liquid, the shipping of the liquid accommodation body which is filled with the liquid, and the packaging of the liquid accommodation body which is filled with the liquid.

In other words, examples of the "chronological information relating to the manufacture of the liquid accommodation body 100" include, when the chronological information is the date and/or the time, the date and/or the time based on at least one of the acts of the act of manufacturing the components of the liquid, the act of manufacturing the liquid, the act of accommodating the liquid, the act of shipping the liquid accommodation body which is filled with the liquid, and the act of packaging the liquid accommodation body which is filled with the liquid. In addition, when the chronological information is an elapsed period, the elapsed period from the date and/or the time based on at least one type of act of the act of manufacturing the components of the liquid, the act of manufacturing the liquid, the act of accommodating the liquid, the act of packaging the liquid accommodation body which is filled with the liquid, and the act of shipping the liquid accommodation body which is filled with the liquid can be exemplified. Even among these, from a perspective of being able to clearly understand the situation in which the gas of the liquid accommodation body is generated, it is preferable to adopt at least the information of one of (1) a date and/or a time based on the act of manufacturing the liquid or the components thereof, (2) a date and/or a time based on the act of accommodating the liquid in the liquid accommodation body 100, (3) an elapsed period from a date and/or a time based on the act of manufacturing the liquid or the components thereof, (4) an elapsed period from a date and/or a time based on the act of accommodating the liquid in the liquid accommodation body 100. Note that, the term "based on" indicates a time which is set in relation to the act, and does not indicate the time of the moment at which the act was performed.

It is possible to appropriately control the discharging of the gas by understanding the amount of the gas which the liquid generates based on the chronological information such as that described above. In other words, it is possible to adjust the timing at which the gas is discharged, the method of discharging the gas, the degree to which the gas is discharged and the like.

1.2. Liquid

The liquid which is accommodated in the liquid accommodation body 100 (the liquid accommodation chamber 10) of the present embodiment is not particularly limited, as long as the liquid generates a gas as time elapses due to a chemical change in the contained components. Here, a chemical change in the contained components indicates at least one of one type of the contained components being altered (decomposed, structurally changed or the like) and changing into another material (including gases), and two or more types of the contained components reacting with each other and changing into one or a plurality of materials (including gases) which are different from the original components. As the liquid which is accommodated in the liquid accommodation body 100 of the present embodiment, a liquid in which two or more types of the contained components react with each other and change into one or a plurality of materials (including gases) which are different from the original components is preferable.

In addition, to generate a gas as time elapses refers to there being a period in which a gas is generated together with the passage of time. Therefore, the liquid which is accommodated in the liquid accommodation body 100 is a liquid in which there is a period in which a chemical change in the contained components occurs and a gas is generated, and includes a liquid in a state before the contained components chemically change or in a state after the chemical change in the contained components is completed.

Examples of the liquid include a liquid which contains components such as a material which may undergo a chemical change due to heat, light or the like, and a combination of materials which may react with each other due to their mutual presence. In addition, the liquid accommodation body 100 is an ink cartridge for ink jet recording, and when an ink is accommodated therein as the liquid, an ink containing a metallic pigment and an ink containing a dye may be exemplified as the liquid (the ink), for example. In particular, an ink containing a metallic pigment and water may be exemplified, and an ink formed of a material in which the metallic pigment contains a base metal may be exemplified as an ink which easily generates a gas as time elapses. Here, the term base metal is a metal which is also referred to as a base metal, and refers to a metal with a greater tendency to ionize than hydrogen. As typical examples of the base metal, an alkali metal, an alkali earth metal, aluminum, lead and the like may be exemplified. The metallic pigment may be an alloy containing at least one of the base metals. These materials react with the water or the organic solvent contained in the ink, and have a tendency to generate many bubbles (gas).

Hereinafter, description will be given of an ink composition which contains an aluminum pigment with a material of the base metal aluminum as a metal pigment, and water, as an aspect of the liquid of the present embodiment.

<Aluminum Pigment>

Examples of the aluminum pigment include pigments with a tabular shape. A plate shape is, for example, a shape such as scaly shaped, leaf shaped, plate shaped, film shaped or the like. The aluminum pigment may be covered with an inorganic oxide or the like. There is a case in which it is possible to suppress the generation of bubbles (gas) in the ink due to the aluminum pigment being covered. When the aluminum pigment is a plate shape, it is easy to obtain favorable metallic glossiness when the ink is adhered to the recording medium.

Of the aluminum pigment which is covered by a cover film, a 50% mean particle diameter R50 (hereinafter, also simply referred to as "R50") of an equivalent circle diameter which is obtained from the area of a projected image of the particles which is obtained using a particle image analyzer apparatus is 0.5 μm to 2 μm, and is preferably 0.7 μm to 1.8 μm.

Examples of the particle image analyzer apparatus for measuring the area and the equivalent circle diameter of the projected image of the aluminum pigment particles include the flow-type particle image analyzer apparatuses such as the FPIA-2100, the FPIA-3000, and the FPIA-3000S (all manufactured by Sysmex Corporation). Note that, the mean particle diameter of the equivalent circle diameter referred to here is the particle diameter based on a singular basis. In addition, as the measurement method when using the FPIA-3000 or the FPIA-3000S, using a high magnification imaging unit and measuring using an HPF measurement aspect may be exemplified.

In the present embodiment, it is preferable that the maximum value of the equivalent circle diameter of the aluminum pigment particles be 3 μm or less. When the maximum equivalent circle diameter of the particles is 3 μm or less, it is possible to suppress clogging in the nozzle opening portions and the ink flow path when the ink jet printer is used.

In addition, the thickness of the aluminum pigment particles is 5 nm to 100 nm, is preferably 5 nm to 70 nm, and is more preferably 10 nm to 50 nm.

Note that, the thickness is measured using a transmission electron microscope or a scanning electron microscope, and the transmission electron microscope (TEM: JEOL, JEM-2000EX), the field emission scanning electron microscope (FE-SEM: Hitachi, S-4700) and the like may be exemplified. Note that, the thickness means the mean thickness, and is the mean value obtained by performing the measurement 10 times.

It is preferable that a material containing, for example, alkoxysilane (for example, tetraethoxysilane (TEOS)), polysilazane, or a compound derived from these compounds, a fluorine-based material, a phosphor-based material, or a phosphoric acid-based material be used as the material of the cover film of a case in which the aluminum pigment has a cover film.

In addition, the aluminum pigment may be supplied in the state of a dispersion. As the components contained in the dispersion of the aluminum pigment, water, an organic solvent, a basic catalyst, a surfactant, a tertiary amine, a buffer solution or the like may be exemplified, and the components may be mixed as appropriate.

<Water>

It is preferable to use ion-exchanged water, ultrafiltered water, reverse osmosis water, or pure water or ultra-pure water such as distilled water, as the water. In particular, it is preferable to use water obtained by subjecting the above-described water to sterilization treatment such as ultraviolet radiation or hydrogen peroxide addition, since doing so allows the occurrence of mold and bacteria to be suppressed over a long period.

<Other>

The ink composition, which is an example of the liquid, may contain other components. Examples of the other components include an organic solvent, a catalyst, a surfactant, a buffering agent, alkane diol, a pyrrolidone derivative, a ph-adjusting agent, a fixing agent of water-soluble rosin or the like, an antifungal agent or a preservative such as sodium benzoate, an antioxidant or an ultraviolet absorber such as allophanate, a chelating agent, and additives such as oxygen absorbers.

<Ink Composition>

In regard to the concentration of the aluminum pigment in the ink composition in relation to the total mass of the ink composition, as the solid content concentration, 0.1 to 5.0 mass % is preferable, 0.1 to 3.0 mass % is more preferable, 0.25 to 2.5 mass % is yet more preferable, and 0.5 to 2.0 mass % is particularly preferable. As the viscosity of the ink composition at 20° C., 2 mPa·s to 10 mPa·s is preferable, and 3 mPa·s to 5 mPa·s is more preferable.

The ink composition may be obtained by mixing the components in an arbitrary order, and removing impurities by subjecting the mixture to filtration as necessary. An example of a mixing method of the components which is favorably used is a method in which the materials are sequentially added to a container provided with a stirring apparatus such as a mechanical stirrer or a magnetic stirrer and then mixed by stirring. As the filtration method, centrifugal filtration, filter filtration, or the like may be performed as necessary.

It is possible to use the ink composition exemplified above as the liquid which is accommodated in the liquid accommodation body 100 of the present embodiment. Since the above-described ink composition contains the aluminum pigment and the water, gas is generated as time elapses. Note that, the time of manufacture of the aluminum pigment (the liquid component) indicates a time at which the aluminum pigment or the covered aluminum pigment is in a state in which contact may be made with the water, and the time of manufacture of the ink composition (the liquid) indicates a time at which a series of processes such as the mixing, the filtering and the like described above are completed. Furthermore, the time at which the liquid is accommodated in the liquid accommodation body 100 indicates, after introducing the liquid into the liquid accommodation body 100, the time at which sealing is performed when sealing is performed as necessary, and indicates the time at which the liquid is introduced when sealing is not performed.

1.3. Recording Head

The recording head 310 according to the present embodiment communicates with the liquid accommodation chambers of the liquid accommodation bodies 100, 110, 120, and 130, and ejects the liquids which are supplied from the liquid accommodation bodies 100, 110, 120, and 130. Specifically, the recording head 310 is supplied with the liquid of the inner portion of the liquid accommodation chamber 10 via the liquid flow path 20 which is connected to the liquid supply tube 200. In this manner, the recording head 310 enters a state in which it is possible to eject the liquid from the nozzles (not shown) which are provided on a bottom surface side (the side facing a recording medium P) of the recording head.

Any system may be used as the ink jet recording system of the recording head 310, and examples thereof include a system in which a strong electric field is applied between a nozzle and an acceleration electrode placed in front of the nozzle, the ink droplets are continually ejected from the nozzle, and recording is performed by applying a printing information signal to deflection electrodes during the period in which the ink droplets fly between the deflection electrodes, or a system in which the ink droplets are ejected corresponding to the printing information signal without being deflected (an electrostatic suction system), a system in which the ink droplets are forcefully ejected by applying pressure to the ink liquid using a miniature pump and mechanically causing the nozzle to oscillate using a quartz oscillator or the like, a system in which pressure and the printing information signal are applied to the ink at the same time using a piezoelectric element to eject and record the ink droplets (a piezo system), and a system in which the ink is foamed by heating using microelectrodes in accordance with the printing information signal to eject and record the ink droplets (a thermal jet system).

Figure 3:
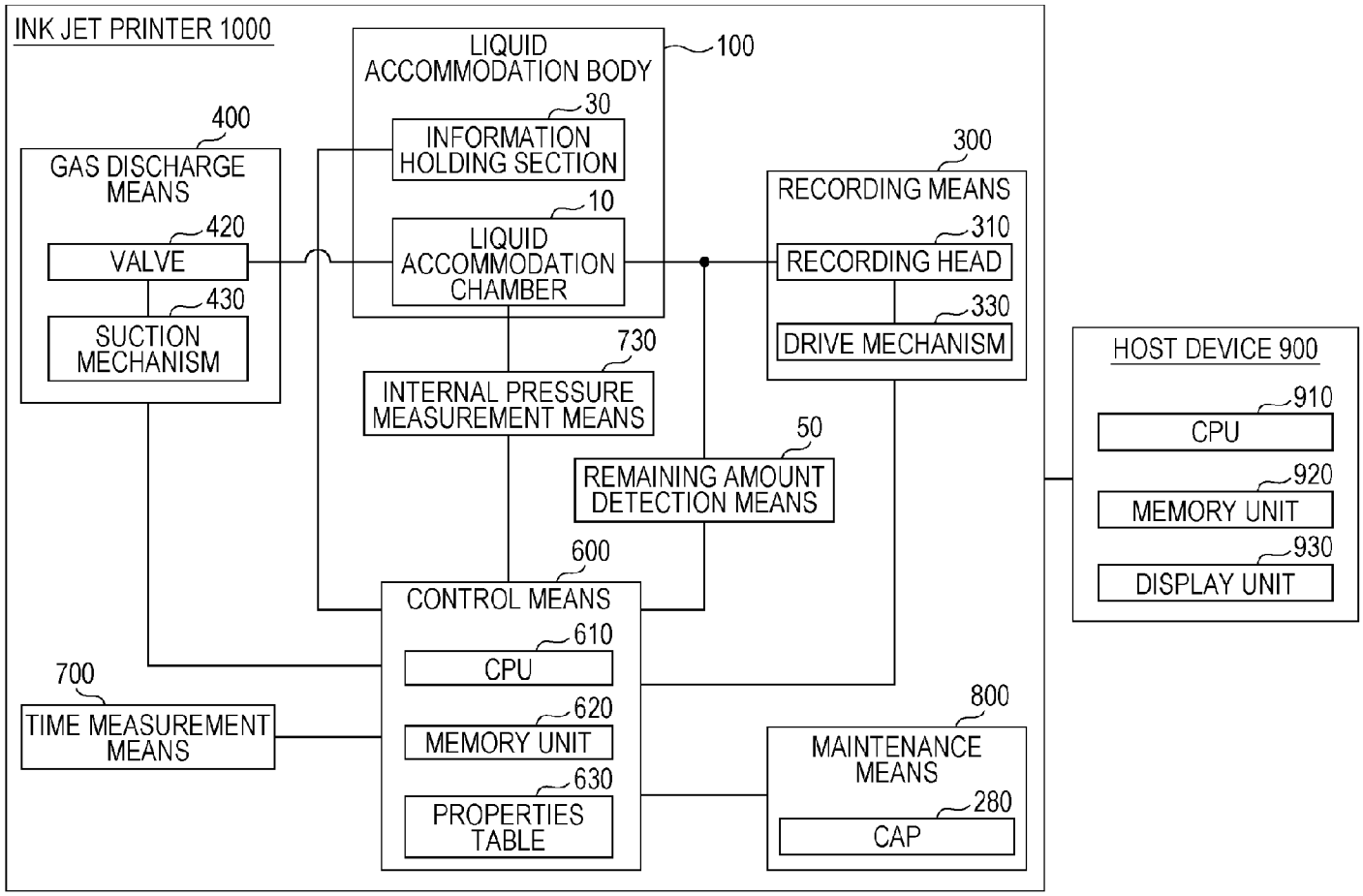
FIG. 3 is a diagram showing an example of the functional blocks including the ink jet printer according to an embodiment of the present invention.

The recording head 310 is one of the components of recording means 300 (refer to FIG. 3). The recording means 300 includes, in addition to the recording head 310, a drive mechanism 330 which causes the recording head 310 to move reciprocally, for example. The drive mechanism 330 is provided with a timing belt, and a drive motor or the like for driving the timing belt. The recording head 310 can move reciprocally along the X axis due to the drive mechanism 330.

In the present embodiment, a so-called serial head-type ink jet printer in which recording is performed while causing the recording head 310 to move reciprocally in a main scanning direction (the ±X axis direction) is exemplified; however the present invention may also be applied to a so-called line head type ink jet printer which uses a line-type recording head that does not move reciprocally.

1.4. Gas Discharge Means

The gas discharge means 400 according to the present embodiment is a means for executing an initial discharge operation and a second discharge operation, which will be described later. The gas discharge means 400 communicates with the gas flow path 40, and causes the gas, which is generated in the inner portion of the liquid accommodation body 100, to be discharged to the outside.

It is possible to provide the gas discharge means 400 in an arbitrary position of the printer 1000. In the example of FIG. 1, the gas discharge means 400 is attached to the side surface of the outside of the housing of the printer 1000; however, the gas discharge means 400 may be provided on the inner portion of the housing.

In the present embodiment, the gas discharge means 400 is provided with a valve 420 and a suction mechanism 430 (refer to FIG. 3). The valve 420 and the suction mechanism 430 are controlled by control means 600 which is described later. It is possible to use a solenoid valve which opens and closes according to the commands of the control means 600 as the valve 420. In addition, it is possible to use a well-known suction pump for the suction mechanism 430. Detailed description will be given later of the control of the gas discharge means 400 using the valve 420 and the suction mechanism 430.

The gas which is discharged to the outside of the liquid accommodation body 100 by the gas discharge means 400 may be collected by gas storage means (not shown) such as a gas cylinder which is connected to the gas discharge means 400, and may be discharged into the atmosphere. When the gas is discharged into the atmosphere, two or more gas discharge ports (not shown) for discharging the gas into the atmosphere are provided, and the gas is not discharged to one place in a concentrated manner due to disposing the gas discharge ports at separated positions; thus, it is possible to reduce the risk of explosion or ignition when a volatile gas is discharged. In addition, it is possible to reduce the risk of explosion or ignition caused by the discharged gas by disposing the gas discharge ports in positions that are distanced from locations of the printer 1000 which easily become hot (for example, the circuit board or the like). Note that, when the gas is collected or discharged into the atmosphere, it is necessary to ensure that the gas and the atmosphere do not flow backward into the liquid accommodation chamber 10 side by closing the valve 420 or the like.

The gas discharge means 400 may discharge the liquid of the inner portion of the liquid accommodation chamber 10 together with the gas which is generated in the liquid accommodation chamber 10. In other words, a combination of the gas and the liquid may be discharged by the gas discharge means 400. When the gas discharge means 400 is caused to operate by estimating the amount of the gas which is generated in the liquid accommodation chamber 10, there is a likelihood that the amount of the gas which is actually generated is greater than the amount of the gas which is estimated. In addition, there is a case in which the gas which is generated in the liquid accommodation chamber does not separate from the liquid and is mixed with the liquid. Accordingly, by discharging the liquid together with the gas, it is possible to more reliably discharge the gas of the inner portion of the liquid accommodation chamber 10, or to discharge more of the gas.

As shown in FIG. 2(B), an automatic opening/closing valve 400A which opens and closes automatically corresponding to changes in the internal pressure of the liquid accommodation chamber 10 may be adopted as the gas discharge means 400 instead of the valve 420 or the suction mechanism 430 which is controlled by the control means 600. FIG. 2(B) is a schematic view of a cross section of a liquid accommodation body 100A according to a modification example. The liquid accommodation body 100A shown in FIG. 2(B) is configured in the same manner as the liquid accommodation body 100 of FIG. 2(A), except in that the automatic opening/closing valve 400A is provided. The automatic opening/closing valve 400A can be provided in the gas flow path 40, as shown in FIG. 2(B). Alternatively, it is possible to provide the automatic opening/closing valve 400A in the gas discharge path which is connected to the gas flow path 40. Furthermore, the automatic opening/closing valve 400A is configured to automatically open and discharge the gas when the internal pressure of the liquid accommodation chamber 10 exceeds a predetermined value due to the gas which is generated in the liquid accommodation chamber 10, and to subsequently automatically close due to the internal pressure of the liquid accommodation chamber 10 decreasing. In the same manner as the gas discharge means 400 described earlier, the gas which is discharged to the outside of the liquid accommodation body 100A may be collected by gas storage means (not shown) such as a gas cylinder which is connected to the gas discharge path 40, and may be discharged into the atmosphere. When the gas is collected or discharged into the atmosphere, the automatic opening/closing valve 400A also functions as a non-return valve for preventing the gas and the atmosphere from flowing backwards into the liquid accommodation chamber 10 side.

1.5. Other Configurations

The ink jet printer according to the present embodiment includes time measurement means, internal pressure measurement means, remaining amount detection means, maintenance means, control means, and the like. FIG. 3 is a view showing an example of the functional blocks including the printer 1000.

<Time Measurement Means>

The time measurement means 700 is not particularly limited as long as the time measurement means 700 is capable of storing the time, and a timer or the like may be used. The time measurement means 700 may be provided in any position of the printer 1000, and may be built into the control means 600 described later. In addition, the time measurement means 700 may be attached to the liquid accommodation body 100, as described above.

It is preferable that the time measurement means 700 be capable of storing the time even when the power of the printer 1000 is off. For example, a rechargeable battery may be built into the time measurement means 700. The time measurement means 700 may be capable of resetting the starting of time measurement or the cumulating of time.

The time measurement means 700 is not limited to means which uses a resettable timer. For example, the time measurement means 700 may be means which has a gear that rotates within the apparatus, counts the number of rotations of the gear, and correlates the number of rotations of the gear with the elapsed time to measure the time. The time measurement means 700 may be time measurement means which uses another mechanism. In addition, there is timer means which stores the total cumulative time, which may store the total cumulative time of the time of the previous operation, and, from the total cumulative time of the time of the next operation, obtain a difference between this and the stored total cumulative time to determine the elapsed time.

Specifically, the time measurement means 700 can measure the time of the elapsed time from the initial discharge operation (described later) until the second discharge operation (described later), the elapsed time from the second discharge operation until the next second discharge operation, and the like.

<Internal Pressure Measurement Means>

Internal pressure measurement means 730 is means for measuring the internal pressure of the liquid accommodation chamber 10, and is used for providing the internal pressure information to the control means 600. The internal pressure measurement means 730 is not particularly limited as long as the internal pressure measurement means 730 can measure the internal pressure of the liquid accommodation body 100; for example, it is possible to use a well-known internal pressure meter. The internal pressure measurement means 730 may be provided in any position of the printer 1000, as long as it is possible to measure the internal pressure of the liquid accommodation body 100.

The internal pressure information which is obtained by the internal pressure measurement means 730 is acquired by the control means 600 which is described later. The internal pressure information which the control means 600 obtains from the internal pressure measurement means 730, for example, may be the present internal pressure value of the liquid accommodation chamber 10, and may be a pressure difference from the internal pressure value of a predetermined time until the present internal pressure value. The control means 600 can perform a determination of whether it is necessary to execute each discharge operation described later using the obtained internal pressure information.

If at least one of the time measurement means 700 and the internal pressure measurement means 730 is provided, it is possible to easily execute the initial discharge operation and the second discharge operation at the appropriate timing. It is possible to omit the time measurement means 700 and the internal pressure measurement means 730 in a case in which the flow including the initial discharge operation and the second discharge operation, which are described later, is not carried out, or in a case in which these are not used in the flow.

<Remaining Amount Detection Means>

The remaining amount detection means 50 is means for detecting the presence or absence of the liquid in the liquid accommodation chamber 10, when little of the liquid remains in the liquid accommodation chamber 10, or the like. The detection of the liquid by the remaining amount detection means 50 is carried out based on the absence or presence, the flow amount, the pressure or the like of the liquid which is pumped from the liquid accommodation chamber 10. It is possible to use, for example, a flow meter, a pressure gage, a piezoelectric sensor, the response of which changes depending on the presence or absence of the liquid, as the remaining amount detection means 50. When the remaining amount detection means 50 detects that the liquid is depleted or that little of the liquid remains, the remaining amount detection means 50 causes the recording by the recording head 310 to stop; thus, it is possible to prevent the recording head 310 from operating in a state in which the liquid is not present, and it is possible to reduce damage to the recording head 310.

<Maintenance Means>

Maintenance means 800 is means for executing a maintenance operation which maintains the recording head 310 according to the commands from the control means 600 which is described later. Specifically, the maintenance operation is an operation in which bubbles (gas) that enter the liquid which is supplied to the recording head 310 are discharged from the nozzles, and the recording head 310 is moisturized and the like.

The maintenance means 800 is provided with a cap 280 (refer to FIG. 1) which is pressed onto a surface (a nozzle surface) on which the nozzles are formed at the lower side of the recording head 310 and which forms a closed space to surround the nozzles, a raising/lowering mechanism (not shown) which raises and lowers the cap 280 in order to press the cap 280 onto the nozzle surface of the recording head 310, a suction pump (not shown) which applies a negative pressure to the closed space which is formed by the cap 280 being pressed onto the nozzle surface of the recording head 310, and the like.

In the example of FIG. 1, a region called a home position is provided in a position of the outside of the recording region to which the recording head 310 is moved along the X axis. The cap 280, which is a portion of the maintenance means 800, is disposed in the home position.

<Control Means>

The control means 600 controls each of the mechanisms of the ink jet printer 1000. For example, the control means 600 controls the gas discharge means 400 based on the information which is acquired from the time measurement means 700, the internal pressure measurement means or the like, or based on the information which is acquired from the information holding section 30 of the liquid accommodation body 100. The control means 600 may generate a signal relating to the execution or the stopping of the various operations such as the recording operation, the gas introduction operation and the maintenance operation, in addition to controlling the gas discharge means 400. Note that, the control means 600 may be disposed in a host device 900.

It is possible to realize the control means 600 using a CPU 610 and a program, for example. The control means 600 can acquire the various information such as the elapsed time information from the time measurement means 700, and the internal pressure information from the internal pressure measurement means 730. The control means 600 may include a memory unit 620 which stores the information relating to the received information, the present time (the year, month, day, and time) and the like. The control means 600 may acquire the information relating to the present time (the year, month, day, and time) and the like from the host device 900 or the like.

Here, description will be given of an example of a case in which the control means 600 is disposed in the host device 900. The host device 900 is, for example, a personal computer, a portable information terminal (PDA: Personal Digital Assistant), can include a CPU 910, receives information (a signal or the like) which is transmitted from the various means or input information from the user, and performs calculations based thereon.

Figure 4:
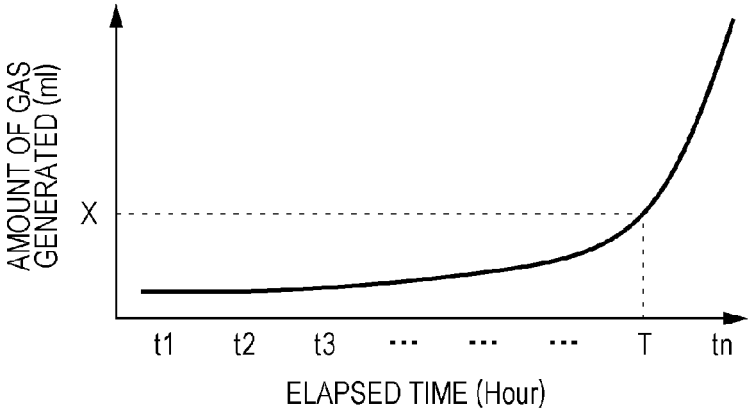
FIG. 4(A) is a graph showing a relationship between an amount of a gas that a liquid generates and the elapsed time.
FIG. 4(B) is an example of a table showing the relationship between the amount of gas that the liquid generates and the elapsed time.
FIG. 4(C) is an example of a table of thresholds (time) according to a type of liquid.

The control means 600 may include a properties table 630 which can be referred to according to the type of the liquid which is accommodated in the liquid accommodation body 100. Examples of the properties table include a table which indicates the relationship between the amount of the gas which is generated by the liquid and the elapsed time, and a table of thresholds (time, pressure and the like) according to the type of the liquid. Description will be given of a specific example of the properties table using FIGS. 4(A) to (C). FIG. 4(A) is a graph showing the relationship between the amount of the gas that the liquid generates and the elapsed time. FIG. 4(B) is an example of the table showing the relationship between the amount of the gas that the liquid generates and the elapsed time, and FIG. 4(C) is an example of the table of thresholds (time) according to the type of the liquid. As shown in FIG. 4(A), the liquid which is accommodated in the liquid accommodation chamber 10 (the ink) generates a gas as time elapses due to a chemical change in the contained components. A plurality of samples of an ink A which had the same components were prepared, and the relationship between the amount of the gas that was generated and the elapsed time was investigated. FIG. 4(A) is a graph of the mean values of the results of the samples. As shown in FIG. 4(B), it is possible to create a properties table showing the relationship between the amount of the gas which the liquid generates and the elapsed time in regard to the ink A by obtaining gas generation amounts a1, a2, a3, . . . an at elapsed times t1, t2, t3, . . . tn from the profile of FIG. 4(A). In FIG. 4(A), only the profile of the ink A is shown; however the profile differs depending on the type of the ink. It is possible to create the properties table showing the relationship between the amount of the gas which the liquid generates and the elapsed time for each type of the ink by creating the profile of FIG. 4(A) for each of the types B, C, D . . . of the ink, and obtaining the gas generation amounts b1 to bn, c1 to cn, d1 to dn . . . an at the elapsed times t1, t2, t3, . . . tn. Using a similar method, as shown in FIG. 4(C), it is possible to create a table of thresholds (time) Ta, Tb, Tc, Td . . . according to the type of the ink A, B, C, D . . . by creating the profile of FIG. 4(A) for each of the types of ink, and obtaining the elapsed time T until a threshold X of the gas generation amount is reached for each of the types of ink.

The host device 900 may control the printer 1000. For example, the host device 900 may control the recording (the rendering) by the printer 1000. In this case, the host device 900 may further include a memory unit 920.

The memory unit 920 is, for example, semiconductor memory, a hard disk drive or the like, and may be configured integrally with the host device 900. The information which is stored in the memory unit 920 is, for example, transmitted to a display unit 930.

The display unit 930, for example, is configured of a display panel (a liquid crystal monitor or the like), a light-emitting body, a speaker and the like. The display unit 930 may be designed to display or announce based on the information which is acquired from the various means such that the user can recognize the content thereof.

<Other>

There is a case in which the liquid accommodation body 100 according to the present embodiment is removed from the printer 1000 before the liquid which is accommodated in the liquid accommodation chamber 10 is sufficiently consumed. In addition, there is a case in which the liquid which is accommodated in the liquid accommodation chamber 10 generates a gas which has safety problems such as hydrogen. In other words, there is a case in which there is a demand to appropriately dispose of the liquid accommodation body 100 when the liquid accommodation body 100 is removed from the printer 1000 and is discarded.

In this manner, in order to appropriately dispose of the used liquid accommodation body 100, if there is notification means (not shown) which notifies the user of the disposal method of the liquid accommodation body 100 that is removed, it is possible to prompt the user to appropriately dispose of the liquid accommodation body 100.

Examples of the notification means include a display unit (for example, a display panel (a liquid crystal monitor or the like), a light-emitting body, a speaker or the like) which is provided on the printer 1000, the display unit 930 which is provided on the host device 900, and a medium which is attached to the liquid accommodation body 100. The user causes the gas to be discharged from the liquid accommodation body 100 according to the processing method which the user is notified of by the notification means.

Examples of the processing method include methods in which gas release holes which are provided in advance in the liquid accommodation body 100 are opened, and in which a hole is created in the liquid accommodation body 100 using a needle or the like.

Meanwhile, when the liquid accommodation body 100 is removed from the printer 1000, if a mechanism in which the gas is discharged from the liquid accommodation body 100 is provided, there is a case in which the notification means is not necessary. For example, if a needle or the like is provided in the cartridge holder 150 and the needle penetrates the inner portion of the liquid accommodation chamber 10 by the time that the liquid accommodation body 100 is removed, since a hole is created when removing the liquid accommodation body 100, it is possible to release the gas into the atmosphere. In addition, a sealed gas release hole is provided in the liquid accommodation chamber 10, and a mechanism in which the gas release hole is opened when the liquid accommodation body 100 is removed from the printer 1000 may be provided. Therefore, even if there is no notification means, it is possible to safely dispose of (discard) the liquid accommodation body 100. Note that, the mechanism may also be used as the notification means, and in this case, there is a case in which the safety during disposal is further increased.

2. Control Process of Gas Discharge Means

Next, description will be given of an example of the control process of the gas discharge means in the printer 1000 according to the present embodiment, while referencing the flow charts of FIGS. 5 to 7. In the flows hereinafter, a case in which the control means 600 executes the information acquisition and the determination process to execute the flows is shown; however, the flows may be executed by a semiconductor chip attached to the liquid accommodation body 100 or the host device 900 performing the information acquisition and the determination process. Note that, when the automatic opening/closing valve 400A which is provided in the gas flow path 40 shown in FIG. 2(B) is used as the gas discharge means, it is not necessary to perform a control process such as that described hereinafter.

2.1. Flow Including Initial Discharge Operation

The present flow including the initial discharge operation is executed when the liquid accommodation body 100 is first mounted to the printer 1000. Hereinafter, description will be given of the present flow including an initial operation using the flow chart of FIG. 5.

First, the liquid accommodation body 100, which the user obtains by purchasing or the like, is mounted to the printer 1000. The control means 600 detects that the liquid accommodation body 100 is inserted, and acquires information from the mounted liquid accommodation body 100 and the printer 1000 (step S10). Various mechanical or electrical well-known methods are known as the method of the control means 600 detecting that the liquid accommodation body 100 is inserted. In the present embodiment, since it is possible to adopt any of the well-known methods, detailed description thereof will be omitted.

Next, the control means 600 performs the determination process relating to whether or not it is necessary to discharge the gas using the gas discharge means 400 (step S20). When the control means 600 determines that the discharging of the gas is not necessary (NO in step S20), the control means 600 waits for a command of recording or the like from the host device 900 and ends the present flow. Meanwhile, when the control means 600 determines that the discharging of the gas is necessary (YES in step S20), the control means 600 causes the gas discharge means 400 to operate to execute the gas discharge operation (the initial discharge operation, step S30). Specifically, the control means 600 opens the valve 420, drives the suction mechanism 430 to discharge a fixed amount of the gas (or a combination of the gas and the liquid), and subsequently closes the valve 420.

Next, the control means 600 resets the time measurement means 700. Alternatively, the control means 600 causes the memory unit 620 to store the information of the time (the year, month, day, and time) relating to the initial discharge operation (step S40). In the present flow, step S40 is executed after step S30; however the invention is not limited thereto and step S40 may be executed before or at the same time as step S30.

Here, the resetting of the time measurement means 700 or the recording of the information to the memory unit 620 (step S40) is carried out in order to determine whether or not it is necessary to execute the second discharge operation which is described later. When the information of the time measurement means 700 or the memory unit 620 is not used in order to determine whether or not it is necessary to execute the second discharge operation, it is possible to omit step S40. The timing at which to carry out step S40 may be, for example, the time in step S20 at which the control means 600 determines that it is necessary to discharge the gas, the time at which the initial discharge operation (step S30) is started (for example, the time at which the valve 420 is opened, or the time at which the driving of the suction mechanism 430 is started), or the time at which the initial discharge operation (step S30) is completed (for example, the time at which the valve 420 is closed or the time at which the driving of the suction mechanism 430 is completed). In addition, the memory unit 620 may be caused to store the information of the time (the year, month, day, and time) in relation to the timing. Furthermore, the time information may be stored in the information holding section 30 of the liquid accommodation body 100.

After carrying out the resetting of the time measurement means 700 or the recording of the information to the memory unit 620, the control means 600 waits for a command of recording or the like from the host device 900 and ends the present flow.

Note that, before the liquid accommodation body 100 is mounted to the printer 1000, there is a case in which a certain amount of gas is generated in the liquid accommodation chamber 10. Therefore, when the liquid accommodation body 100 is mounted to the printer 1000, it is preferable that the present flow be executed according to the determination of the control means 600 before any information is input to the control means 600 or the host device 900. Accordingly, it is possible to prevent damage to the liquid accommodation body 100.

Figure 5:
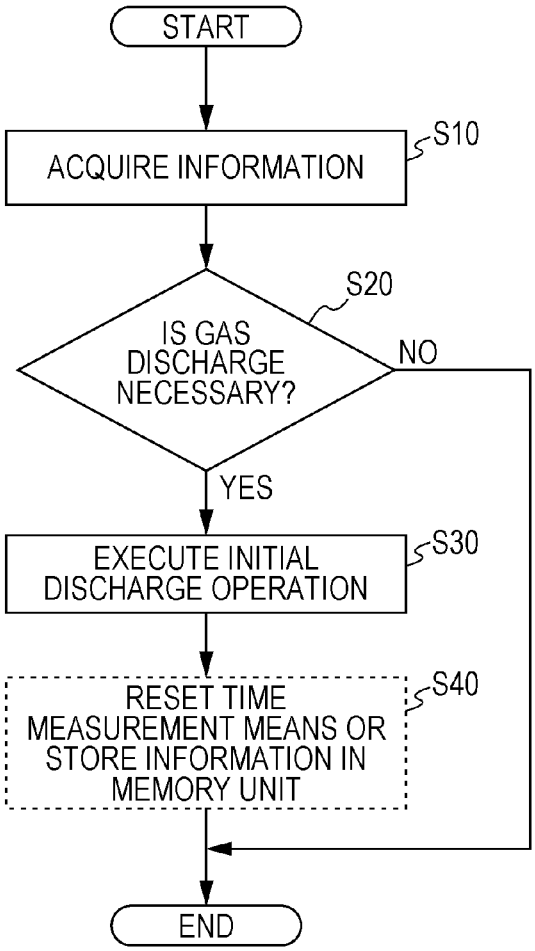
FIG. 5 is an example of a flowchart showing control processes of gas discharge means according to an embodiment of the present invention.

Three types of specific example will be introduced using the flow shown in FIG. 5.

Specific Example 1

The control means 600 causes the internal pressure measurement means 730 to measure the internal pressure of the liquid accommodation body 100 after the liquid accommodation body 100 is inserted. Then, the control means 600 acquires the information relating to the internal pressure of the liquid accommodation body 100 (step S10). Next, the control means 600 determines whether or not the internal pressure of the liquid accommodation body 100 is the threshold or greater (step S20). When the internal pressure of the liquid accommodation body 100 is less than the threshold and the control means 600 determines that the initial discharge operation is not necessary (NO in step S20), the control means 600 waits for a command of recording or the like from the host device 900 and ends the present flow. When the internal pressure of the liquid accommodation body 100 is the threshold or greater and the control means 600 determines that the initial discharge operation is necessary (YES in step S20), the control means 600 causes the gas discharge means 400 to operate to execute the gas discharge operation (the initial discharge operation, step S30). Subsequently, the control means 600 waits for a command of recording or the like from the host device 900 and ends the present flow. In specific example 1, step S40 is omitted.

Specific Example 2

After the liquid accommodation body 100 is inserted, the control means 600 accesses the information holding section of the liquid accommodation body 100, and acquires the chronological information relating to the manufacture of the liquid accommodation body 100, for example, the information of the year, month and day of manufacture of the liquid accommodation body 100 (step S10). In addition, the control means 600 acquires the information relating to the type of the ink which is accommodated in the liquid accommodation body 100 from the information holding section 30 of the liquid accommodation body 100. Next, the control means 600 causes computing means which is not shown to calculate the elapsed time from the manufacture time of the liquid accommodation body 100 until the present based on the information of the time (the year, month, day, and time) relating to the manufacture which is obtained from the liquid accommodation body 100, and based on the information of the present time (the year, month, day, and time) which is held in the memory unit 620. Furthermore, the information of the gas generation amount is acquired by comparing the information relating to the elapsed time and the type of ink which is accommodated in the liquid accommodation body 100 with the properties table shown in FIG. 4(B). Furthermore, the control means 600 determines whether or not the internal pressure of the liquid accommodation body 100 is the threshold or greater by comparing the obtained value of the gas generation amount with the properties table shown in FIG. 4(C) (step S20). When the internal pressure of the liquid accommodation body 100 is less than the threshold and the control means 600 determines that the initial discharge operation is not necessary (NO in step S20), the control means 600 waits for a command of recording or the like from the host device 900 and ends the present flow. Meanwhile, when the internal pressure of the liquid accommodation body 100 is the threshold or greater and the control means 600 determines that the initial discharge operation is necessary (YES in step S20), the control means 600 causes the gas discharge means 400 to operate to execute the initial discharge operation (step S30). Furthermore, when the initial discharge operation is completed, the control means 600 resets the time measurement means 700 (step S40). Subsequently, the control means 600 waits for a command of recording or the like from the host device 900 and ends the present flow.

Specific Example 3

In step S40 of specific example 2, when the initial discharge operation is completed, the control means 600 may cause the memory unit 620 to store the information of the time (the year, month, day, and time) at which the initial discharge operation is completed instead of resetting the time measurement means 700.

2.2. Flow Including Second Discharge Operation

It is preferable to also perform discharging of the gas using the gas discharge means 400 at a predetermined timing after the flow including the initial discharge operation which is described above is executed. An discharge operation of the gas which is carried out after the flow including the initial discharge operation which is described above is executed is referred to as the "second discharge operation". When the initial discharge operation is carried out in the flow described above, the second discharge operation is the second or later discharge operation of the gas, when the initial discharge operation is not carried out, the second discharge operation is the first or later discharge operation of the gas. The second discharge operation is carried out when an execution command of the second discharge operation is input from the user based on the determination of the control means 600. Hereinafter, description will be given of the flow of the second discharge operation which is performed based on the determination of the control means 600, based on FIGS. 6 and 7. In regard to the flow of FIG. 6 and the flow of FIG. 7, only one may be carried out, and both of them may be executed in succession. In addition, these flows may be carried out a plurality of times. When the flows are carried out a plurality of times, only one of the flow of FIG. 6 and the flow of FIG. 7 may be carried out a plurality of times, each time one may be carried out a plurality of times, the other may be carried out once or a plurality of times, and the two flows may be carried out once at a time, alternately.

2.2.1. Flow for Safety

The present flow is a flow which is performed after the flow including the initial discharge operation which is described above is executed, and is a flow that is preferable to execute regardless of the input of an execution command of a recording operation or the signal of power ON, OFF or the like from the user. In other words, even if the ink jet printer is in a power OFF state or a waiting state, there is a case in which gas continues to be generated from the liquid of the inner portion of the liquid accommodation chamber 10. In this case, when the gas discharge operation is not carried out, there is a case in which the liquid accommodation body 100 is damaged by the gas which is generated from the liquid of the inner portion of the liquid accommodation chamber 10. Therefore, in the present flow, it is preferable that the gas discharge operation be executed at a predetermined timing based on the determination of the control means 600 for safety.

Hereinafter, description will be given of the present flow using the flow chart of FIG. 6.

First, the control means 600 acquires the information from the internal pressure measurement means 730, the time measurement means 700, or the memory unit 620 (step S50). It is preferable that the acquisition of this information by the control means 600 always be performed for safety, regardless of reception of the various commands such as the reception of power ON, power OFF, and recording operation commands. The term "always" includes a case in which the acquisition of the information is performed periodically, every short period of time of a predetermined degree. Even when the printer 1000 is not connected to the power, it is possible to execute the present flow using a rechargeable battery or the like which is built into the printer 1000.

Next, the control means 600 performs the determination process relating to whether or not it is necessary to discharge the gas using the gas discharge means 400 (step S60). When the control means 600 determines that the discharging of the gas is necessary (YES in step S60), the control means 600 causes the gas discharge means 400 to operate to execute the gas discharge operation (step S80). Specifically, the control means 600 opens the valve 420, drives the suction mechanism 430 to discharge a fixed amount of the gas (or a combination of the gas and the liquid), and subsequently closes the valve 420.

Next, the control means 600 resets the time measurement means 700. Alternatively, the control means 600 causes the memory unit 620 to store the information of the time (the year, month, day, and time) relating to the second discharge operation (step S80). Subsequently, the process returns to step S50 again and the present flow is restarted. In the present flow, step S90 is executed after step S80; however the invention is not limited thereto and step S90 may be executed before or at the same time as step S80. Note that, the resetting of the time measurement means 700 or the recording of the information to the memory unit 620 (step S90) is carried out after the process returns to step S50 again in order to determine whether or not it is necessary to execute the next second discharge operation. When the information of the time measurement means 700 or the memory unit 620 is not used in order to determine whether or not it is necessary to execute the second discharge operation, it is possible to omit step S90.

The timing at which to carry out step S80 may be, for example, the time in step S60 at which the control means 600 determines that it is necessary to discharge the gas, the time at which the second discharge operation (step S80) is started (for example, the time at which the valve 420 is opened, or the time at which the driving of the suction mechanism 430 is started), or the time at which the second discharge operation (step S80) is completed (for example, the time at which the valve 420 is closed or the time at which the driving of the suction mechanism 430 is completed). In addition, the memory unit 620 may be caused to store the information of the time (the year, month, day, and time) in relation to the timing. Furthermore, the time information may be stored in the information holding section 30 of the liquid accommodation body 100.

Meanwhile, in step S60, when the control means 600 determines that the discharging of the gas is not necessary (NO in step S60), the control means 600 acquires the information relating to the remaining amount of the liquid of the liquid accommodation chamber 10 from the remaining amount detection means 50. Then, the control means 600 performs the determination of whether or not the amount of liquid remaining in the liquid accommodation chamber 10 is a predetermined amount or greater based on the information (step S70). As a result of the determination, when the amount of liquid remaining in the liquid accommodation chamber 10 is the predetermined amount or greater (YES in step S70), the process returns to step S50 again and the present flow is restarted. Meanwhile, as a result of the determination of step S70, when the amount of liquid remaining in the liquid accommodation chamber 10 is less than the predetermined amount (NO in step S70), the present flow is ended.

Note that, when the amount of the liquid remaining in the liquid accommodation chamber 10 is less than the predetermined amount, since the amount of gas which is generated in the inner portion of the liquid accommodation chamber 10 is negligible, there is no concern that the liquid accommodation body 100 will be damaged. Therefore, even if the present flow is ended, no safety problems arise.

Figure 6:
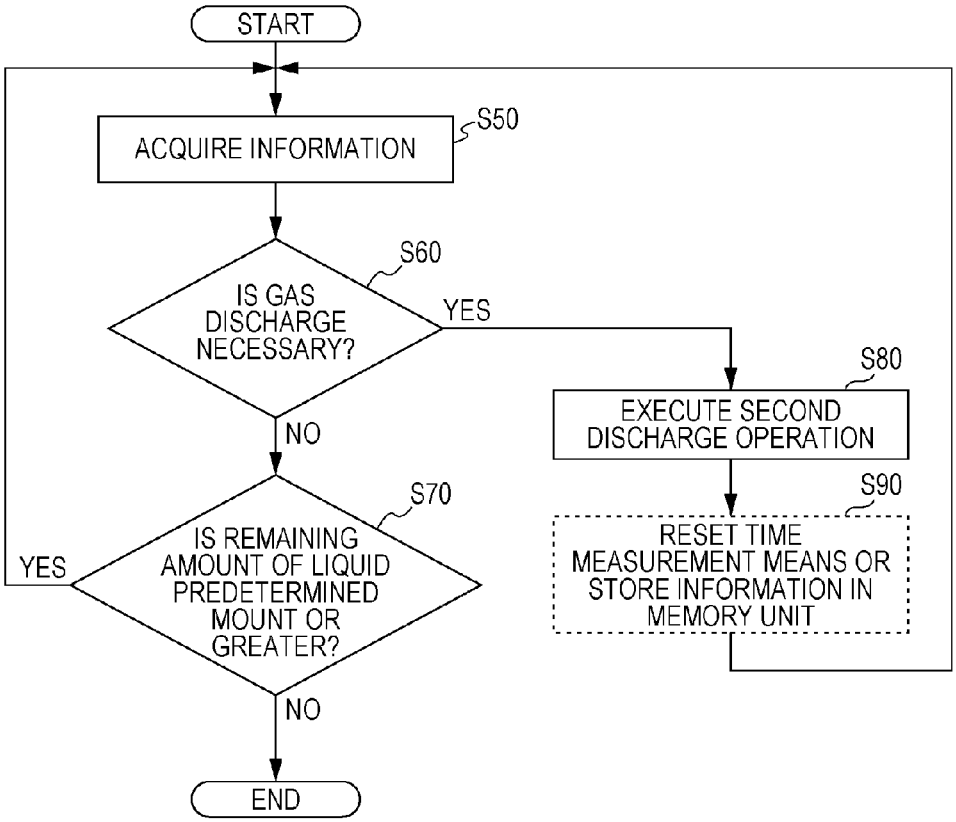
FIG. 6 is an example of a flowchart showing control processes of the gas discharge means according to an embodiment of the present invention.
Figure 7:
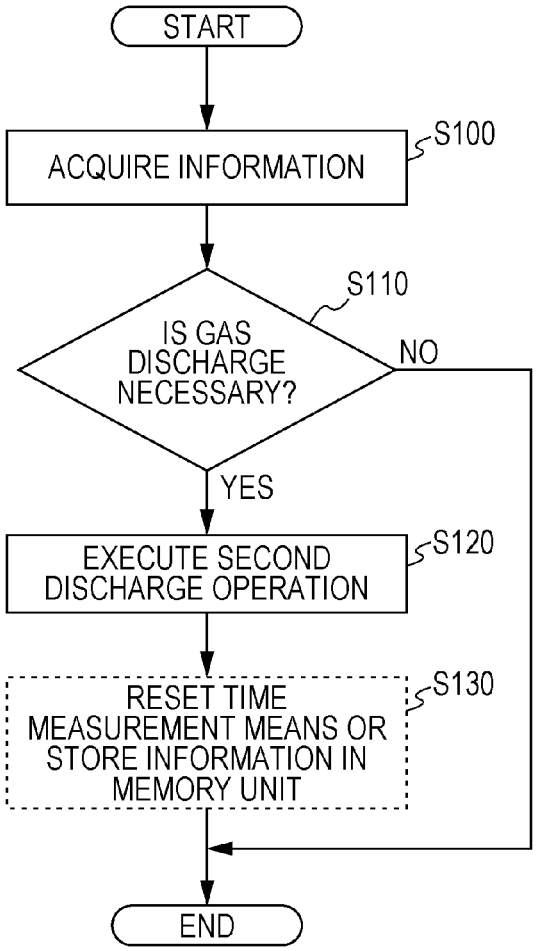
FIG. 7 is an example of a flowchart showing control processes of the gas discharge means according to an embodiment of the present invention.

Three types of specific example will be introduced using the flow shown in FIG. 6.

Specific Example 1

First, the control means 600 causes the internal pressure measurement means 730 to periodically measure the internal pressure of the liquid accommodation body 100. Then, the control means 600 acquires the information relating to the internal pressure of the liquid accommodation body 100 (step S50).

Next, the control means 600 determines whether or not the second discharge operation is necessary (step S60). When the internal pressure of the liquid accommodation body 100 is the threshold or greater and the control means 600 determines that the second discharge operation is necessary (YES in step S60), the control means 600 causes the gas discharge means 400 to operate to execute the gas discharge operation (the second discharge operation, step S80). As the threshold, a value may be set in advance such that the liquid accommodation body 100 is not damaged, and the memory unit 620 may be caused to store the threshold. Alternatively, when different thresholds are set for each type of the ink, the properties table 630, to which the thresholds of the internal pressure of the liquid accommodation body 100 are set for each type of the ink, may be provided. Then, in step S50, the control means 600 may acquire the information of the threshold corresponding to an ink by acquiring the information of the ink from the information holding section 30 of the liquid accommodation body and comparing the obtained information of the ink with the properties table 630.

After carrying out the second discharge operation (step S80), the control means 600 returns to step S50 and carries out step S50 again.

Meanwhile, in step S60, when the internal pressure of the liquid accommodation body 100 is lower than the threshold, and the control means 600 determines that the second discharge operation is not necessary (NO in step S60), the control means 600 acquires the information relating to the remaining amount of the liquid of the liquid accommodation chamber 10 from the remaining amount detection means 50. Then, the control means 600 performs the determination of whether or not the amount of liquid remaining in the liquid accommodation chamber 10 is a predetermined amount or greater based on the information (step S70). As a result of the determination, when the amount of liquid remaining in the liquid accommodation chamber 10 is the predetermined amount or greater (YES in step S70), the process returns to step S50 again and the present flow is restarted. Meanwhile, as a result of the determination of step S70, when the amount of liquid remaining in the liquid accommodation chamber 10 is less than the predetermined amount (NO in step S70), the present flow is ended. Note that, in specific example 1, step S90 is omitted.

Specific Example 2

First, the control means 600 periodically accesses the time measurement means 700 to acquire the elapsed time information (step S50). The elapsed time is the elapsed time from the previous time at which the time measurement means 700 was reset.

Next, the control means 600 determines whether or not the second discharge operation is necessary (step S60). When the elapsed time is the threshold or greater and the control means 600 determines that the second discharge operation is necessary (YES in step S60), the control means 600 causes the gas discharge means 400 to operate to execute the gas discharge operation (the second discharge operation, step S80). As the threshold, a sufficiently short time may be set in advance such that the liquid accommodation body 100 is not damaged, and the memory unit 620 may be caused to store the threshold. Alternatively, when different thresholds are set for each type of the ink, the properties table 630, to which the thresholds of the elapsed time of the liquid accommodation body 100 are set for each type of the ink, may be provided. Then, in step S50, the control means 600 may acquire the information of the threshold corresponding to an ink by acquiring the information of the ink from the information holding section 30 of the liquid accommodation body and comparing the obtained information of the ink with the properties table 630.

After carrying out the second discharge operation (step S80), the control means 600 resets the time measurement means 700 (step S90). Subsequently, the process returns to step S50 and step S50 is carried out again.

Meanwhile, in step S60, when the elapsed time is less than the threshold, and the control means 600 determines that the second discharge operation is not necessary (NO in step S60), the control means 600 acquires the information relating to the remaining amount of the liquid of the liquid accommodation chamber 10 from the remaining amount detection means 50. Then, the control means 600 performs the determination of whether or not the amount of liquid remaining in the liquid accommodation chamber 10 is a predetermined amount or greater based on the information (step S70). As a result of the determination, when the amount of liquid remaining in the liquid accommodation chamber 10 is the predetermined amount or greater (YES in step S70), the process returns to step S50 again and the present flow is restarted. Meanwhile, as a result of the determination of step S70, when the amount of liquid remaining in the liquid accommodation chamber 10 is less than the predetermined amount (NO in step S70), the present flow is ended.

Specific Example 3

In step S50 of specific example 2, the control means 600 may acquire the time information which is held by the memory unit 620 by accessing the memory unit 620 (step S50) instead of acquiring the elapsed time information by accessing the time measurement means 700. The time information, for example, is information of the time (the year, month, day, and time) at which the previous discharge operation (the initial discharge operation or the second discharge operation) is completed. In this case, the determination of whether or not the second discharge operation is necessary (step S60) may be carried out by comparing the time information which is acquired in step S50 with the present time information which is held in the control means 600 itself, and calculating the elapsed time. Furthermore, in step S90, the memory unit 620 may be caused to store the information of the time (the year, month, day, and the time) at which the second discharge operation is completed instead of resetting the time measurement means 700.

2.2.2. Flow of Case in which Predetermined Command is Executed

The present flow is a flow which is performed after the flow including the initial discharge operation which is described above is executed, and is a flow that is preferable to execute after the initial discharge operation is executed when the control means 600 receives power ON, power OFF, a recording operation command, a wait command or the like of the printer 1000.

Hereinafter, description will be given of the present flow using the flow chart of FIG. 7.

First, the control means 600 acquires the information from the internal pressure measurement means 730, the time measurement means 700, or the memory unit 620 (step S100). It is possible to set the acquisition of this information by the control means 600 to be performed when the various commands such as the reception of power ON, power OFF, and recording operation commands are received.

Next, the control means 600 performs the determination process relating to whether or not it is necessary to discharge the gas using the gas discharge means 400 (step S110). When the control means 600 determines that the discharging of the gas is not necessary (NO in step S110), the control means 600 executes the command which is received by the control means 600 during startup, and ends the present flow. Meanwhile, when the control means 600 determines that the discharging of the gas is necessary (YES in step S110), the control means 600 causes the gas discharge means 400 to operate to execute the gas discharge operation (step S120). Specifically, the control means 600 opens the valve 420, drives the suction mechanism 430 to discharge a fixed amount of the gas (or a combination of the gas and the liquid), and subsequently closes the valve 420.

Next, the control means 600 resets the time measurement means 700. Alternatively, the control means 600 causes the memory unit 620 to store the information of the time relating to the second discharge operation (step S130). Subsequently, the control means 600 executes the command which is received by the control means 600 during startup, and ends the present flow. In the present flow, step S130 is executed after step S120; however the invention is not limited thereto and step S130 may be executed before or at the same time as step S120. Note that, the resetting of the time measurement means 700 or the recording of the information to the memory unit 620 (step S130) is carried out in order to determine whether or not it is necessary to execute the second discharge operation next time. In order to determine whether or not it is necessary to execute the next second discharge operation, when the information of the time measurement means 700 or the memory unit 620 is not used, it is possible to omit step S130.

The timing at which to carry out step S130 may be, for example, the time in step S110 at which the control means 600 determines that it is necessary to discharge the gas, the time at which the second discharge operation (step S120) is started (for example, the time at which the valve 420 is opened, or the time at which the driving of the suction mechanism 430 is started), or the time at which the second discharge operation (step S120) is completed (for example, the time at which the valve 420 is closed or the time at which the driving of the suction mechanism 430 is completed). In addition, the memory unit 620 may be caused to store the information of the time (the year, month, day, and time) in relation to the timing. Furthermore, the time information may be stored in the information holding section 30 of the liquid accommodation body 100.

Specifically, it is possible to carry out the present flow by applying step S50 in specific example 1 to specific example 3 of the flow of FIG. 6 which was described earlier to step S100, step S60 to step S110, step S80 to step S120, and step S90 to step S130.

2.3. Other Operations

The printer 1000 according to the present embodiment can execute the gas introduction operation or the maintenance operation which are described above, in addition to the various operations described above. These operations may be executed according to the execution commands from the user, and may be executed based on the information which is stored in advance in the memory unit 620 of the control means 600 or the like.

The printer 1000 according to the present embodiment is provided with a liquid flow path (the liquid flow path 20) which is used for supplying the ink to the head, and a gas flow path (the gas flow path 40) for discharging the gas which is generated in the inner portion of the liquid accommodation chamber 10 separately. Therefore, it is possible to execute the recording operation and the gas discharge operation at the same time. Accordingly, even when the gas is generated in the inner portion of the liquid accommodation chamber 10 during recording, it is possible to discharge the gas to the outside of the liquid accommodation body 100 without interrupting the recording operation.

The present invention is not limited to the embodiments described above, and various modifications thereof are possible. For example, the present invention includes configurations which are the substantially the same as the configurations described in the embodiments (for example, configurations having the same function, method and results, or configurations having the same object and effect). In addition, the present invention includes configurations in which non-essential parts of the configurations described in the embodiments are replaced. In addition, the present invention includes configurations exhibiting the same operations and effects as the configurations described in the embodiments or configurations capable of achieving the same object. In addition, the present invention includes configurations in which known techniques were added to the configurations described in the embodiments.

The invention claimed is:

1. An ink jet printer, comprising:

a liquid accommodation body which is provided with a liquid accommodation chamber which accommodates a liquid that generates a gas as time elapses due to a chemical change in contained components, a liquid flow port which communicates with the liquid accommodation chamber and allows the liquid to flow therethrough, and a gas flow port which communicates with the liquid accommodation chamber and allows the gas to flow therethrough;

a recording head which communicates with the liquid flow port and ejects the liquid which flows out from the liquid flow port; and gas discharge means which communicates with the gas flow port and allows the gas to flow out to outside of the liquid accommodation body, wherein the ink jet printer includes at least one of time measurement means which measures elapsed time from a previous discharge operation of the gas, and internal pressure measurement means which measures an internal pressure in the liquid accommodation chamber.

2. The ink jet printer according to claim 1, wherein at least one type of the contained components is a base metal pigment.

3. The ink jet printer according to claim 2, wherein the base metal pigment is covered by a protective film.

4. The ink jet printer according to claim 1, wherein the gas discharge means is provided with a valve and a suction mechanism.

5. The ink jet printer according to claim 1, further comprising:

control means;

wherein the control means causes the gas discharge means to operate based on information of at least one of elapsed time information from the time measurement means, and internal pressure information from the internal pressure measurement means.

6. The ink jet printer according to claim 1, wherein the gas discharge means discharges the liquid of an inner portion of the liquid accommodation chamber together with the gas which is generated in the liquid accommodation chamber.

7. The ink jet printer according to claim 1, further comprising:

notification means which notifies a user of a disposal method of the liquid accommodation body that is removed when the liquid accommodation body is removed from the ink jet printer and is replaced with a different liquid accommodation body.

8. An ink jet printer, comprising:

a liquid accommodation body which is provided with a liquid accommodation chamber which accommodates a liquid that generates a gas as time elapses due to a chemical change in contained components, a liquid flow port which communicates with the liquid accommodation chamber and allows the liquid to flow therethrough, and a gas flow port which communicates with the liquid accommodation chamber and allows the gas to flow therethrough;

a recording head which communicates with the liquid flow port and ejects the liquid which flows out from the liquid flow port; and gas discharge means which communicates with the gas flow port and allows the gas to flow out to outside of the liquid accommodation body, wherein the gas discharge means discharges the liquid of an inner portion of the liquid accommodation chamber together with the gas which is generated in the liquid accommodation chamber.

9. An ink jet printer, comprising:

a liquid accommodation body which is provided with a liquid accommodation chamber which accommodates a liquid that generates a gas as time elapses due to a chemical change in contained components, a liquid flow port which communicates with the liquid accommodation chamber and allows the liquid to flow therethrough, and a gas flow port which communicates with the liquid accommodation chamber and allows the gas to flow therethrough;

a recording head which communicates with the liquid flow port and ejects the liquid which flows out from the liquid flow port;

gas discharge means which communicates with the gas flow port and allows the gas to flow out to outside of the liquid accommodation body; and notification means which notifies a user of a disposal method of the liquid accommodation body that is removed when the liquid accommodation body is removed from the ink jet printer and is replaced with a different liquid accommodation body.

* * * * *